United States Patent [19]

Deutsch

[11] Patent Number: 4,467,691

[45] Date of Patent: Aug. 28, 1984

[54] SELECTABLE ENSEMBLE EFFECT IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 499,047

[22] Filed: May 27, 1983

[51] Int. Cl.[3] ..... G10H 1/02

[52] U.S. Cl. ..... 84/1.24; 84/DIG. 4; 84/1.19

[58] Field of Search ..... 84/1.24, 1.19, 1.01, 84/1.03, DIG. 4

[56] References Cited

U.S. PATENT DOCUMENTS 4,205,580 6/1980 Deutsch ..... 84/1.24

4,228,717 10/1980 Luce ..... 84/1.24

*Primary Examiner*—Forester W. Isen

*Attorney, Agent, or Firm*—Ralph Deutsch

[57] ABSTRACT

A keyboard operated electronic musical instrument is disclosed which has a number of tone generators which are assigned to actuated keyswitches. The tone generation is produced by sequentially and repetitively accessing a memory containing a set of data points which define a period of a preselected musical waveshape. Apparatus is described whereby a plurality of tone generators are implemented such that each has an ensemble tone effect created by adding together a number of composite tones. Each tone generator is implemented by selecting a corresponding set of data points read out of the memory. The selection logic is controlled by select gates and a comparator which is responsive to the frequency of an associated actuated keyboard switch.

18 Claims, 7 Drawing Figures

SELECTABLE ENSEMBLE EFFECT IN AN ELECTRONIC MUSICAL INSTRUMENT

BACKGROUND OF THE INVENTION

1. Field of the Invention

This invention relates to electronic musical tone synthesis and in particular is concerned with the production of an ensemble effect.

2. Description of the Prior Art

It is well known that the tonal production by an electronic musical instrument is enhanced by generating tones which have an ensemble quality. The usual method of producing an ensemble effect is to generate two or more tones whose fundamental frequencies differ by some small frequency difference. The motivation for this arrangement of frequencies is to replicate the ensemble tone produced by a chorus of musical instruments which are not precisely in tune. It is this attribute of "out-of-tune" ensemble that produces the warm tone characteristic of a group of violins even when they are played in unison. All serious attempts to imitate the tonal characteristics of an acoustic piano must accommodate the problem encountered in producing a selectable tone ensemble effect which changes for ranges of notes both in the amount of detuning of the component tones as well as in the number of component tones comprising the ensemble. These changes occur in an acoustic piano which through a period of historic development has led to the current design in which the number of strings struck by the hammers change over the span of the keyboard notes.

Various arrangements have been employed to electronically generate two simultaneous tones which are slightly detuned with respect to each other. The straightforward arrangement is to simply duplicate each tone generator and to use detuned clocks for each tone generator. The straightforward arrangement has the attribute of simplicity which is attained at the expense of duplicating the entire tone generation system. An associated difficulty is that of implementing two clocks which must be only slightly out-of-tune and cannot be permitted to drift independently in frequency with changes in their ambient conditions.

In U.S. Pat. No. 3,809,792 entitled "Production Of Celeste In A Computor Organ" a system is described for producing a celeste version of ensemble tone by computing the amplitudes at successive sample points of a musical waveshape and converting the amplitudes to musical tones as the computations are carried out in real time. Each amplitude is computed during a regular time interval by individually calculating and combining at least two sets of discrete Fourier components. The first set includes harmonically related components, generally the true pitch fundamental and overtones of each keyboard selected note. Components of the second set are offset slightly higher in frequency from those in the first set.

In U.S. Pat. No. 4,112,803 entitled "Ensemble And Anharmonic Generation In A Polyphonic Tone Synthesizer" apparatus is disclosed for producing an ensemble effect in a polyphonic tone synthesizer of the type wherein musical notes are produced polyphonically by computing a master data set, transferring the data set to buffer memories, and repetitively converting in real time the contents of the buffer memories to analog musical waveshapes. A multiplicity of master data sets are created repetitively and independently of tone generation by computing a generalized Fourier-type algorithm using stored sets of harmonic coefficients. The phase of these master data sets are generated with time varying phase shifts to produce the out-of-tune ensemble tone effect. The phase shifted master data sets are combined and transferred to the buffer memories.

In U.S. Pat. No. 4,205,580 entitled "Ensemble Effect In An Electronic Musical Instrument" apparatus is disclosed for producing an ensemble effect in a polyphonic tone synthesizer by providing a master data set of words having values corresponding to the relative amplitudes of equally spaced points along one cycle of the waveform of a musical tone. These values are transferred sequentially during repetitive cycles at a rate proportional to the pitch of the desired musical tone to a digital-to-analog converter for converting the master data set to an audio signal of the desired waveform and pitch. The ensemble effect is produced by transferring the words of the master data set to a second converter at the same pulse rate but having one data point deleted or repeated once in the second set.

In U.S. Pat. No. 4,353,279 entitled "Apparatus For Producing Ensemble Tone In An Electronic Musical Instrument" a system is disclosed for producing an ensemble effect in a digital tone generator by providing a master data set of words having values corresponding to the relative amplitudes of equally spaced points along one cycle of a waveform of a musical tone in which the fundamental frequency is deleted. These values are read sequentially and repetitively from a memory to produce a first analog tone. A second analog tone is produced by multiplying a data set corresponding to the fundamental frequency by a low frequency sinusoid. The first and second analog tones are summed to yield a musical tone having an ensemble effect.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created using a preselected set of harmonic coefficients. At the end of each computation cycle, the computed master data set is stored in a main register.

Following each individual computation cycle, a transfer cycle is initiated during which the stored master data set is transferred to a note register. The master data set stored in the note register is sequentially and repetitively read out at a fixed rate. A plurality of comparators associated with each of a number of tone generators is used to assign the data read out from the note register to a data combination means which combines the plurality of data points selected by the comparators associated with each individual tone generator. Each comparator in the plurality of comparators associated with an assigned tone generator selects data in response to the count state of a counter and an accumulated frequency number that is selected for each assigned tone generator. The output tone generation continues uninterrupted during the computation and transfer cycles.

It is an object of the present invention to provide an ensemble tonal effect with an economy of tone generation circuitry.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic ensemble tone generator in which a number of tone generators produce a selectable ensemble tone effect while sharing waveshape data stored in a single note register. The polyphonic ensemble tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
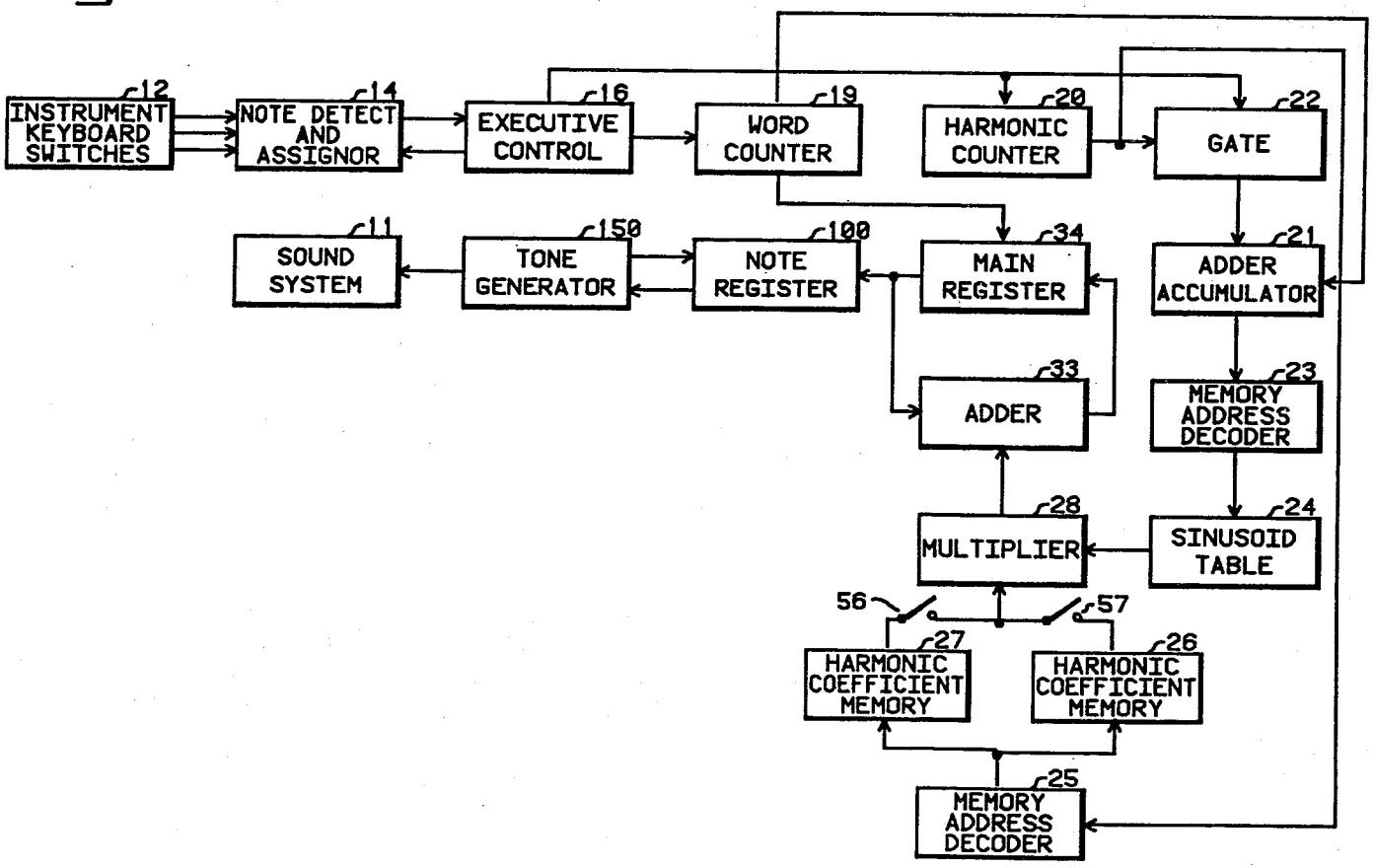
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches. The array is contained in the system block labeled keyboard switches 12. If one or more of the keyboard switches have a switch status change and are actuated ("on" position) on the instrument's keyboard, the note detect and assignor 14 stores the corresponding note information for the actuated keyswitches and one member of a set of tone generators is assigned to each actuated keyswitch. The set of tone generators is contained in the system block labeled tone generator 150. A suitable note detect and assignor subsystem is described in U.S. Pat. No. 4,022,098 which is hereby incorporated by reference.

When one or more keyswitches on the keyboard have been actuated, the executive control 16 initiates a sequence of computation cycles. During each computation cycle, a master data set consisting of 256 data words is computed in a manner described below and stored in the main register 34. The 256 data words in the master data set are generated using a set of 16 harmonic coefficients. The sets of harmonic coefficients are stored in the harmonic coefficient memories 26 and 27. The selection of a particular combination of harmonic coefficients is controlled by the actuation of the tone switches 56 and 57. The tone switches are also called stops or stop switches.

The 256 data words in the master data set correspond to the amplitudes of 256 equally spaced points of one cycle of the audio waveform for the musical tone produced by the set of tone generators comprising the tone generator 150. The general rule is that the maximum number of harmonics in the audio tone spectra is no more than one-half of the number of data points in one complete waveshape period. Therefore, a master data set comprising 256 data points for a maximum of 16 harmonics has a redundant set of 8 points per required waveshape point. The redundant points are used to eliminate the need for a noise reduction system such as interpolation schemes that have been used in a waveshape addressing system in which a polyphonic tone generator is obtained by using some variation of a non-integer frequency divider. An instrument of this type is described in U.S. Pat. No. 4,245,541 and in U.S. Pat. No. 4,256,003. Both of these patents are hereby incorporated by reference.

An alternative to the use of interpolation as a noise reduction means is to use a larger number of waveshape data points than the minimal number dictated by the relation that the minimal number of waveshape data points is equal to two times the specified maximum number of tone harmonics. Experimentally it was verified for representative musical tones that the use of extra waveshape data points produces a tone with less background noise than is obtained with a linear interpolation subsystem employing the same equivalent number of waveshape sample points per waveshape period. The preferred embodiment of the present invention employs 8 redundant data points per required waveshape data point to eliminate the need for a noise reduction subsystem.

At the completion of each computation cycle in the sequence of computation cycles, a transfer cycle is initiated during which the master data set residing in the main register 34 is transferred to the note register 100. The data words stored in the note register 100 are read out sequentially and repetitively and are assigned to each of a number of tone generators in a manner described below. Data assigned to each tone generator is transferred to a digital-to-analog converter which converts the digital data words into an analog waveshape. The digital-to-analog converter is contained in the system block labeled sound system 11. The musical waveshape is transformed into an audible sound by means of a sound system consisting of a conventional amplifier and speaker subsystem which are also contained in the system block labeled sound system 11.

As described in the referenced patent, U.S. Pat. No. 4,085,644, it is desirable to be able to continuously recompute and store the generated master data set during a sequence of computation cycles and to load this data into the note register 100 while the actuated keys remain depressed on the keyboards. This system function is accomplished without interrupting the flow of data points to the digital-to-analog converter.

In the manner described in the referenced patent, U.S. Pat. No. 4,085,644, the harmonic counter 20 and word counter 19 are initialized at the start of each computation cycle. Each time that the word counter 19 is incremented so that it returns to its initial state because of its modulo counting implementation, a signal is provided which increments the count state of the harmonic counter 20. The word counter 19 is implemented to count modulo 256 which is the number of data words in the master data set which is generated and stored in the main register 34. The harmonic counter 20 is implemented to count modulo 16. This number corresponds to the maximum number of harmonics for a waveshape of 256 points that has eight times the minimal number of data points for a maximum of 16 harmonics.

At the start of each computation cycle, the adder-accumulator 21 is initialized to a zero value. Each time that the word counter 19 is reset to its initial value, or minimal count state, the accumulator is reset to a zero value. Each time that the word counter 19 is incremented, the accumulator adds the current count state of the harmonic counter 20 to the sum already contained in the accumulator.

The content of the accumulator in the adder-accumulator 21 is used by the memory address decoder 23 to address out trigonometric sinusoid values from the sinusoid table 24. The sinusoid table 24 is implemented as a read only memory storing values of the trigonometric function sin $(2\pi\phi/256)$ for $0 \leqq \phi \leqq 256$ at intervals of D. D is a table resolution constant.

The multiplier 28 multiplies the trigonometric value read out of the sinusoid table 24 by a harmonic coefficient value. A set of harmonic coefficient values are stored in the harmonic coefficient memories 26 and 27. Harmonic coefficient values are read out of the harmonic coefficient memories 26 and 27 by the memory address decoder 25 in response to the count state of the harmonic counter 20. Switches 56 and 57 are selectively actuated to determine the particular set of harmonic coefficients which are provided to the multiplier 28. The product value formed by the multiplier 28 is furnished as one input to the adder 33. The contents of the main register 34 are initialized to a zero value at the start of a computation cycle. Each time that the word counter 19 is incremented, the contents of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 16 complete count cycles of 256 counts, the main register 34 will contain the master data set corresponding to the selected musical tone produced in response to the actuation states of the tone switches, or stops, 56 and 57.

Figure 2:
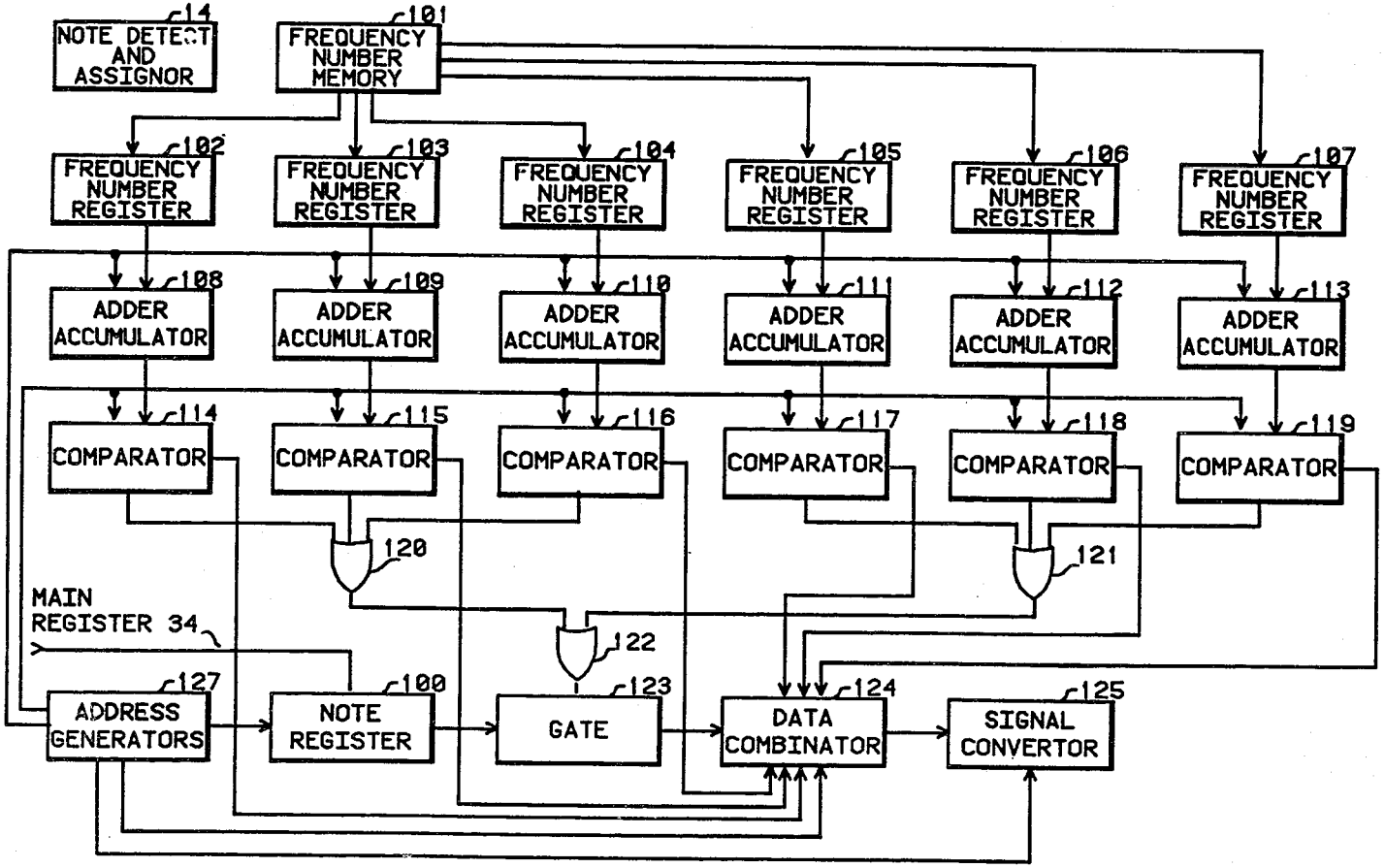
FIG. 2 is a schematic diagram of the tone generators.

FIG. 2 illustrates the logic details for assigning data read out of the note register to each of a number of tone generators. The logic shown in FIG. 2 is contained in the system block labeled tone generator 150. The operation of the assignment logic is a modification and improvement of an assignment logic described in the copending patent application Ser. No. 06/547,302 filed Jan. 11, 1983 entitled A Polyphonic Musical Tone Generator. This application and the present invention are both assigned to the same assignee.

The note detect and assignor 14 detects the keyswitch states on the musical instrument's keyboard. In response to a switch state change from an unactuated to an actuated switch state, the note detect and assignor 14 causes three frequency numbers to be addressed out of the frequency number memory 101.

The frequency number 101 is a read-only addressable memory containing words stored in binary numeric form having values $2^{-(M-N)/12}+\delta$ where N has the range of values N=1, 2, . . . , M and M is equal to the number of keyswitches on the musical instrument's keyboard. $\delta$ is a preselected detuning constant. For each actuated keyswitch, three frequency numbers are available: one with the value $\delta=0$, and the other two with the modified values with $\delta$ and $-\delta$. The frequency numbers represent the ratios of frequencies of generated musical tone with respect to a system timing clock frequency. A detailed description of the frequency numbers is contained in U.S. Pat. No. 4,114,496 entitled "Note Frequency Generator For A Polyphonic Tone Synthesizer." This patent is hereby incorporated by reference.

The three frequency numbers associated with an actuated keyboard switch correspond to the fundamental frequency and two additional frequencies that are detuned so that together an ensemble tonal effect will be produced in the fashion described below.

The three frequency numbers read out of the frequency number memory 101 are stored in a set of three frequency number registers, such as frequency number register 102–104, which corresponds to an assigned tone generator.

Figure 3:
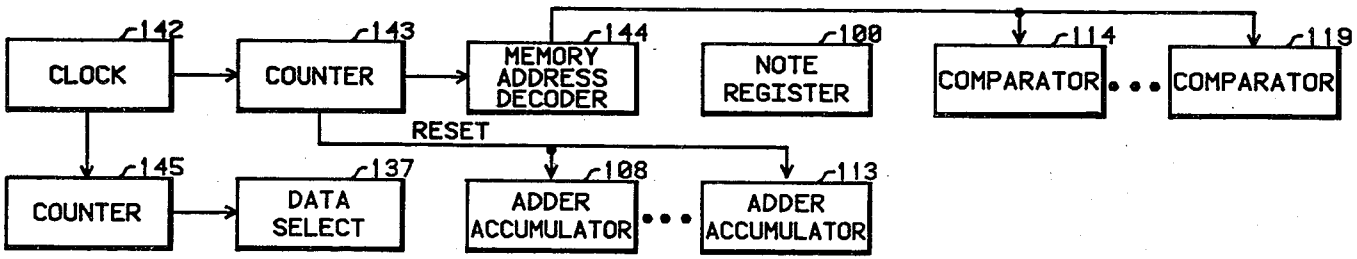
FIG. 3 is a schematic diagram of the address generators 127.

The detailed logic of the address generators 127 is shown in FIG. 3. The counter 143 is incremented by the clock signals provided by the clock 142. Counter 143 is implemented to count modulo 256. Each time that the counter 143 is incremented so that it returns to its minimum count state, a RESET signal is generated. In response to the RESET signal, each one of the set of adder-accumulators 108–113 adds the frequency number contained in its corresponding frequency number register to the sum contained in its accumulator. There is an adder-accumulator associated with each of the frequency number registers. The content of the accumulator is called an accumulated frequency number.

Each of the comparators in the set of comparators 114–119 compares the count state of the counter 143 as decoded by the memory address decoder 144 with the nine most significant bits contained in the accumulator of its associated adder-accumulator. Each of the comparators will generate an EQUAL signal when the two input data words to a comparator are equal. This comparison is equivalent to examining the numerical difference between the count state of the counter 143 and the current address number and generating an EQUAL signal if the difference is less than a preselected comparison number.

OR-gate 120 combines the EQUAL signals produced by the set of three comparators 114–116 which are associated with a first assigned actuated keyboard switch. OR-gate 121 combines the EQUAL signals produced by the set of three comparators 117–119 which are associated with a second assigned actuated keyboard switch. While only two sets of adder-accumulators and OR-gate combinations are shown explicitly in FIG. 2 it is understood that a similar combination is associated with each one of the plurality of tone generators.

The signals produced by the OR-gates 120 and 121 are combined by means of the OR-gate 122 and furnished to the gate 123. In response to a "1" binary state signal transmitted by the OR-gate 122, the gate 123 will transfer the current data value read out from the note register 126 to the data combinator 124. The gate 123 acts as an inhibit gate to prevent data transfer unless an EQUAL signal has been generated by one of the comparators.

As shown in FIG. 3, the memory address decoder 144 decodes the count state of the counter 143 into a set of signal lines which are used to activate the set of comparators 114–119. Although only a single line is shown explicitly in FIG. 2 and FIG. 3 it is understood that this single line represents a set of single lines equal in number to the number of comparators.

Figure 4:
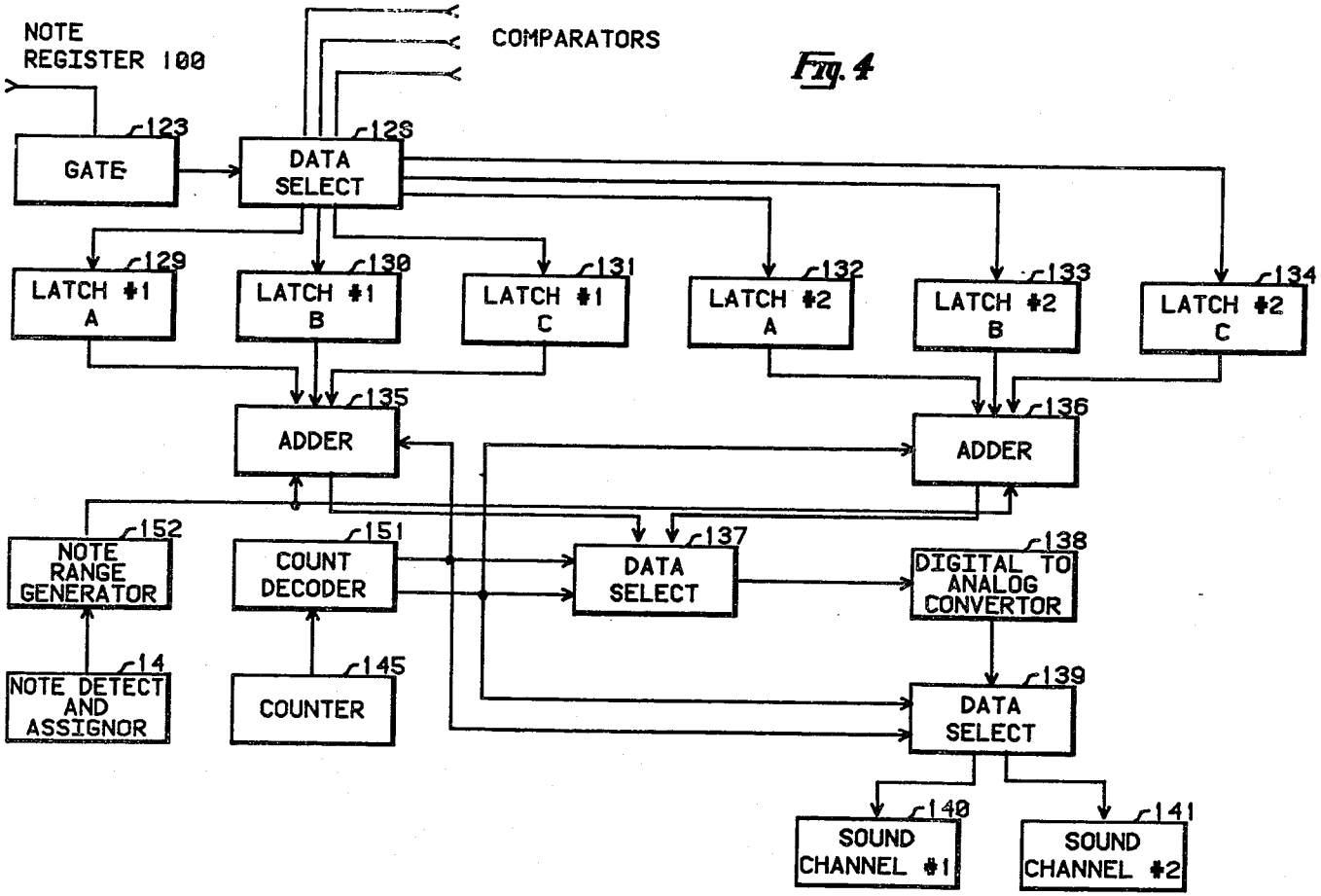
FIG. 4 is a schematic diagram of the data combinator 124.

The logic details of the data combinator 124 are shown in FIG. 4. Each comparator in the set of comparators 114–119 sends its generated EQUAL set of data latches 129–134 in response to the input EQUAL signals.

Figure 5:
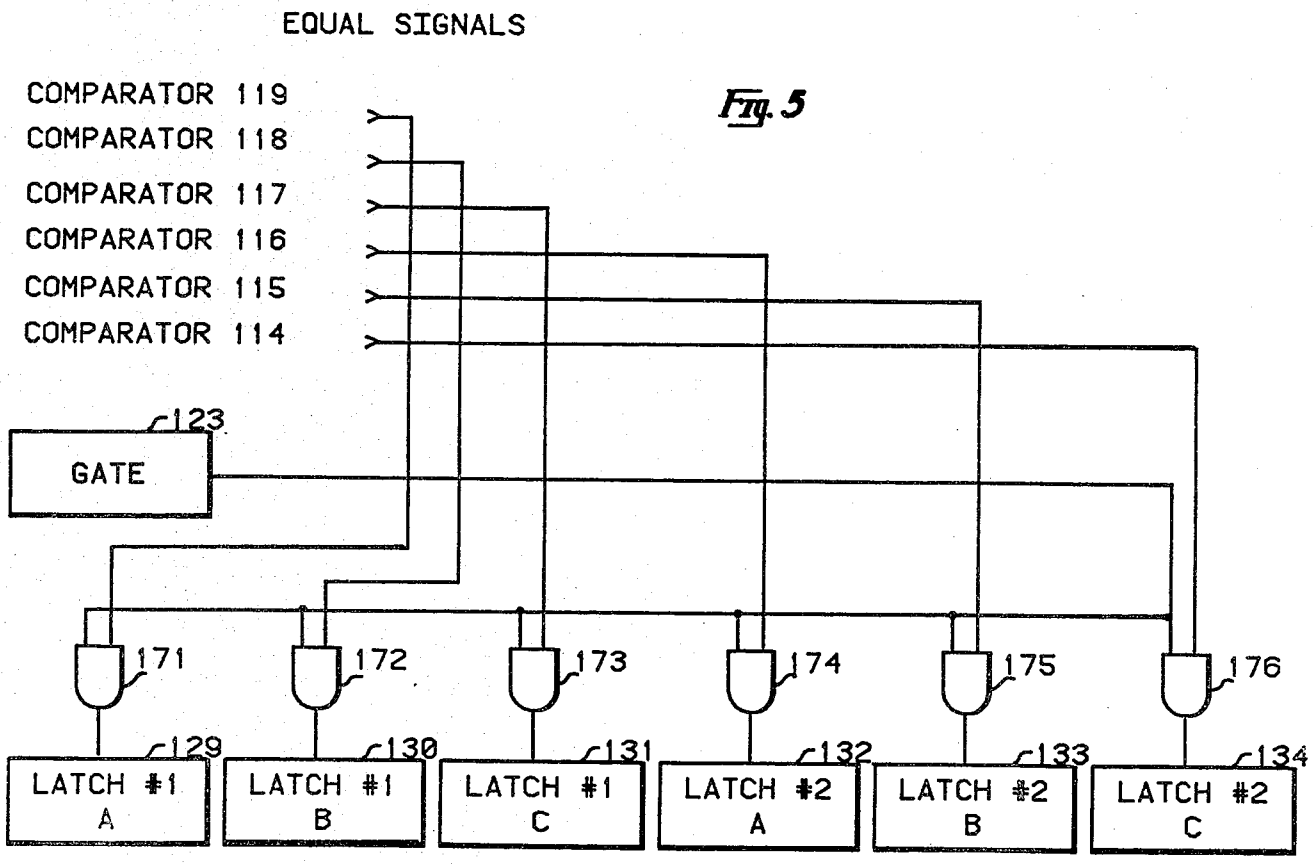
FIG. 5 is a logic diagram of the data select 128.

The logic details of the data select 128 are shown in FIG. 5. The set of AND-gates 171–176 transfer the data output from the gate 123 to an associated data latch in response to an EQUAL signal from any of the set of comparators 114–119. Notice that the same data output can be simultaneously stored in any number of the data latches. While only a single data line is shown explicitly in FIG. 5 from the gate 123, it is understood that this represents a plurality of signal lines equal in number to the number of binary bits used to represent a data point stored in the note register 100.

There are three data latches that are assigned to each actuated keyboard switch. Adder 135 sums the data values contained in the three latches 129, 130, and 131 that are associated with a tone generator designated as #1. The summed data is called a composite data word. The summation is implemented at a time determined by a count state of the counter 145. The count states of the counter 145 are decoded onto a plurality of signal lines by means of the count decoder 151. There is one such signal line corresponding to each one of the set of tone generators in the tone generator 150.

The counter 145 counts the clock signals produced by the clock 142. Counter 145 is implemented to count modulo K, where K is equal to the number of tone generators. Counter 145 must reach a count state of K in the same time required for the counter 143 to reach a count state of 256. Counter 145 can be implemented as a non-integer counter (frequency divider) using an adder-accumulator combination in which a constant value of K/256 is added to the contents of the accumulator at each time epoch provided by the clock 142. The integer portion of the accumulator content is decoded onto separate signal lines by means of the count decoder 151.

In response to the signals provided by the counter decoder 151, the data select transfers the data contained in the set of adder 135–136 to the digital-to-analog converter 138. This arrangement permits the use of a single digital-to-analog converter to be time shared amongst the entire plurality of tone generators.

The data select 139 directs the converted signals from the digital-to-analog converter 138 into independent sound channels in response to the signals provided by the count decoder 151. An alternative arrangement is to simply channel the output from the digital-to-analog converter 138 into a single combination sound channel.

For a tone generation system intended to imitate a musical instrument such as an acoustic piano, the number of component celeste tones for a note must change with the fundamental frequency corresponding to an actuated keyswitch. The change in the number of component celeste tones reflects the acoustic piano design in which one, two, or three strings are struck by a single hammer depending upon the fundamental frequency corresponding to actuated key mechanism.

Figure 6:
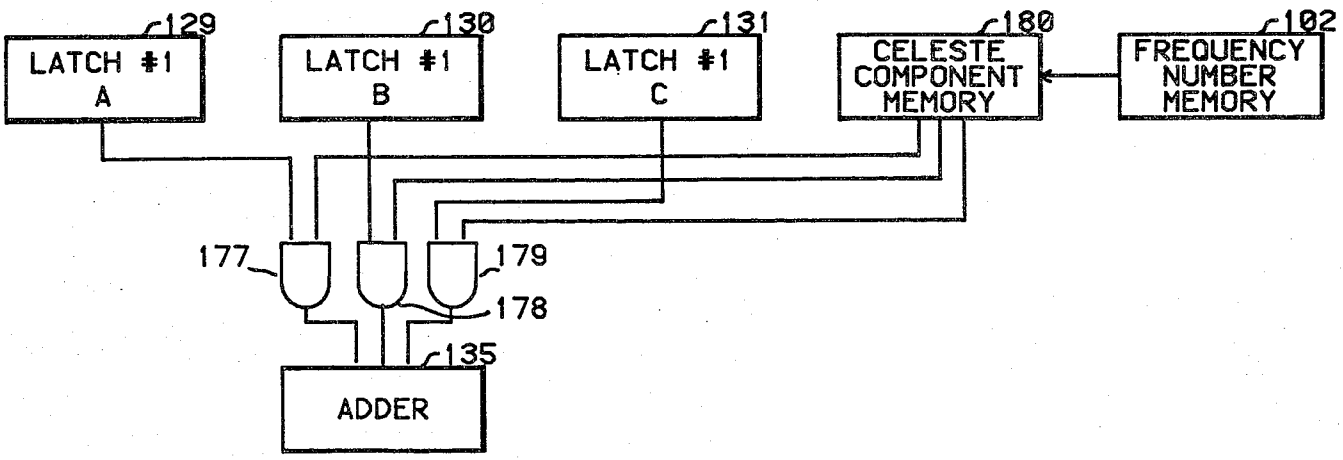
FIG. 6 is an alternate embodiment of the invention.

FIG. 6 illustrates an alternative implementation of the present invention in which a means is introduced to vary the number of component celeste tones as a function of the frequency of the corresponding actuated keyboard switch. The AND-gates 177, 178, and 179 are inserted between the data latches 129–131 and the adder 135. The frequency number resident in the frequency number register is used to access out a 3 bit celeste component word from the celeste component memory. The celeste component word is used by the AND-gates 177–179 to determine which of the data stored in the data latches will be transfered to the associated adder 135.

A subsystem similar to that shown in FIG. 6 is associated with the adder corresponding to each of the tone generators.

Instead of storing three frequency numbers in the frequency number memory 101 for each keyboard note, an alternative arrangement is to store only a single frequency number and then derive the other associated numbers. Table 1 illustrates a method of modifying a single frequency number to obtain the associated frequency numbers.

TABLE 1

| Note | Frequency | Frequency Numbers | Celeste Number | Cents Offset |
|---|---|---|---|---|
| C7 | 2093.01 | 111100011010001 | 111100011110001 | 1.79 |
| B6 | 1975.53 | 111001000001001 | 111001000101001 | 1.90 |
| A#6 | 1864.65 | 110101110100010 | 110101111000010 | 2.01 |
| A6 | 1760.00 | 110010110011000 | 110010110111000 | 2.13 |
| G#6 | 1661.22 | 101111111100100 | 110000000000100 | 2.26 |
| G6 | 1567.98 | 101101010000010 | 101101010100010 | 2.39 |
| F#6 | 1479.98 | 101010101101110 | 101010110001110 | 2.53 |
| F6 | 1396.91 | 101000010100011 | 101000011000011 | 2.68 |
| E6 | 1318.51 | 100110000011100 | 100110000111100 | 2.84 |
| D#6 | 1244.51 | 100011111010110 | 100011111110110 | 3.01 |
| D6 | 1174.66 | 100001111001110 | 100001111101110 | 3.19 |
| C#6 | 1108.73 | 100000000000000 | 100000000100000 | 3.38 |
| C5 | 1046.50 | 011110001101000 | 011110001111000 | 1.79 |
| B5 | 987.77 | 011100100000100 | 011100100010100 | 1.90 |
| A#5 | 932.33 | 011010111010001 | 011010111100001 | 2.01 |
| A5 | 880.00 | 011001011001100 | 011001011011100 | 2.13 |
| G#5 | 830.61 | 010111111110010 | 011000000000010 | 2.26 |
| G5 | 783.99 | 010110101000001 | 010110101010001 | 2.39 |
| F#5 | 739.99 | 010101010110111 | 010101011000111 | 2.53 |
| F5 | 698.46 | 010100001010001 | 010100001100001 | 2.68 |
| E5 | 659.26 | 010011000001110 | 010011000011110 | 2.84 |
| D#5 | 622.25 | 010001111101011 | 010001111111011 | 3.01 |
| D5 | 587.33 | 010000111100111 | 010000111110111 | 3.19 |
| C#5 | 554.37 | 010000000000000 | 010000000010000 | 3.38 |
| C4 | 523.25 | 001111000110100 | 001111000111100 | 1.79 |

The true frequency numbers are stored in the frequency number memory 101 as 15 bit binary digital words. As frequency numbers are accessed out in the top octave range of $B_6$ to $C_7$, a binary number 100000 is added to the least significant bits. The result is called the celeste number which is tabulated in Table 1. The detuning of the celeste number with respect to the true fundamental frequency is shown for each note in the last column of Table 1. The detuning is measured in cents which is computed as $$\text{cents} = 3986.31 \log(\text{celeste frequency}/\text{true frequency}) \qquad \text{Eq. 1}$$

In the next lowest octave, octave 5, a value of 10000 is added to the true frequency. The same scheme is followed for the remaining lower octaves. If the same frequency offset constants are subtracted from the true frequency number a celeste frequency number is generated which is flat by the same number of cents corresponding to an addition of the same frequency offset constant.

It is noted that the preceding algorithm for generating celeste frequency numbers does not produce a constant frequency offset as measured in cents. Such a variation is a desirable attribute because it reduces the mechanical-like frequency precision of an electronic tone generator to approximate the somewhat random tuning of an acoustic musical instrument.

Figure 7:
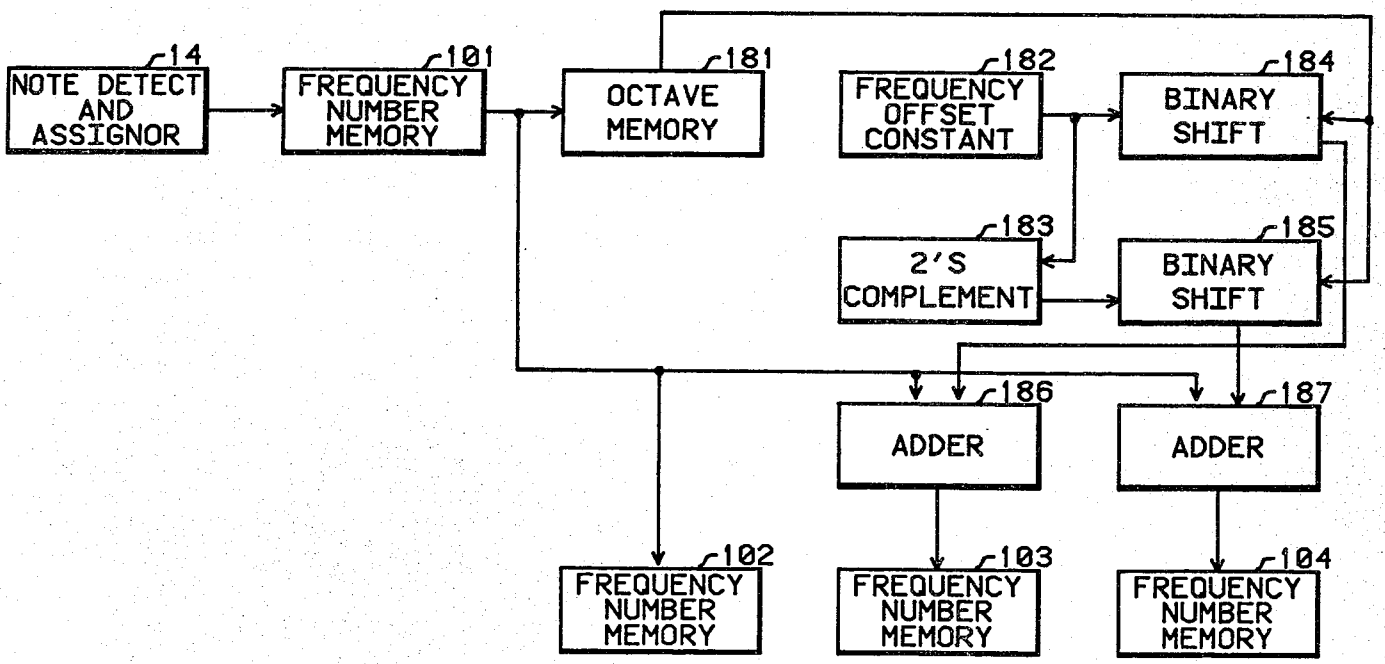
FIG. 7 is a schematic diagram of a celeste frequency offset generator.

FIG. 7 illustrates an alternative implementation of the present invention which incorporates the previously described algorithm for generating celeste frequency numbers from the true frequency number corresponding to an actuated keyboard switch. In response to the frequency number accessed out from the frequency number memory, an octave number is read out of the octave memory 181. A predetermined, or selectable, frequency constant is stored, or inserted, into the frequency offset constant 182. The frequency constant is right shifted by the binary shift 184 by a number of bits which is equal to 6 minus the octave number. The shifted frequency constant is added to the true frequency number by means of the adder 186 and the sum is transferred to the frequency number memory 103.

The frequency offset constant is converted into its corresponding 2's complement form by means of the 2's complement 183. The complemented frequency offset constant is right binary shifted by the binary shift 185 in response to the octave number read out of the octave memory 181. The complemented and right shifted frequency offset constant is added to the true frequency number by means of the adder 187 and the sum is transferred to the frequency number memory 104.

A similar arrangement to that shown in FIG. 7 is implemented for each of the tone generators.

The subject invention is not limited to use as a subsystem of the Polyphonic Tone Synthesizer as described in U.S. Pat. No. 4,085,644. The invention is immediately applicable to any tone generation system in which a waveshape stored in memory is read out sequentially and repetitively. A waveshape generator of this generic type is described in U.S. Pat. No. 3,515,792. This patent is hereby incorporated by reference.

I claim:

1. In a keyboard musical instrument, having a keyboard array of keyswitches, in which a plurality of data words corresponding to the amplitudes of points defining the waveform of a musical tone are computed during a computation cycle and transferred sequentially to a digital-to-analog converter to be converted into musical waveshapes, apparatus for producing a plurality of musical tones each having ensemble effect in response to an actuated keyswitch comprising;

a coefficient memory means for storing a set of harmonic coefficients, a first addressing means for reading out said set of harmonic coefficients from said coefficient memory means, a waveshape memory means, a means for computing responsive to said read out set of harmonic coefficients whereby during said computation cycle said plurality of data words corresponding to said amplitude of points defining the waveform of a musical tone are computed and stored in said waveshape memory means, a keyswitch state detect means wherein a detect signal is generated in response to each actuated keyswitch in said keyboard array of keyswitches, a frequency number means for generating a plurality of frequency numbers in response to each said detect signal, a number of frequency accumulator means each of which corresponds to an actuated keyswitch and each of which comprises a plurality of component accumulator means, a plurality of adder means whereby each of said plurality of frequency numbers is successively added to the contents of an associated one of said component accumulator means to form a plurality of accumulated frequency numbers corresponding to each said detect signal, a second addressing means for sequentially reading out data words stored in said waveshape memory means, a selection gate means responsive to said accumulated frequency numbers whereby data words read out from said waveshape memory means are selected, a data combination means whereby a plurality of data words corresponding to each plurality of accumulator means associated with each said actuated keyswitch are combined to form a combination waveshape data point, and a means for producing musical waveshapes responsive to each said combination data point whereby musical tones are produced having said ensemble effect.

2. In a musical instrument according to claim 1 wherein said frequency number means comprises;

a frequency number memory means for storing a set of frequency numbers, and a third addressing means responsive to each said detect signal whereby a corresponding plurality of frequency numbers are read out from said frequency number memory means.

3. In a musical instrument according to claim 1 wherein said second addressing means comprises;

a clock for providing timing signals, a counter for counting said timing signals modulo the number of said plurality of data words corresponding to said amplitudes of points defining the waveform of a musical tone and wherein a count reset signal is generated each time that the count state of said counter returns to its minimal count state, and a memory accessing means responsive to the contents of said counter for reading out data stored in said waveshape memory means.

4. In a musical instrument according to claim 3 wherein said data combination means comprises a plurality of data latch memory means.

5. In a musical instrument according to claim 4 wherein said selection gate means comprises;

a plurality of comparator means each of which is associated with a corresponding one of said number of frequency accumulator means.

6. In a musical instrument according to claim 5 wherein each one of said plurality of comparator means comprises;

a comparator means responsive to the contents of said counter and responsive to an associated one of said plurality of accumulated frequency numbers whereby an equal signal is generated if the numerical difference between said contents of said counter and said associated accumulated frequency number is less than a preselected comparison number.

7. In a musical instrument according to claim 6 wherein said selection gate means further comprises;

an inhibit gate interposed between said waveshape memory means and said plurality of data latch memory means whereby said data words read out from said waveshape memory means are stored in selected ones of said plurality of data latch memory means in response to each said equal signal.

8. In a musical instrument according to claim 7 wherein said data combination means further comprises;

a tone generator counter for counting each said count reset signal modulo the number of said plurality of musical tones, a number of summing means each of which is associated with a corresponding one of said actuated keyswitches wherein the data words stored in said selected ones of said data latch memory means are added to form a composite data word, and a composite data select means responsive to the contents of said tone generator counter whereby a corresponding composite data word is selected and provided to said means for producing musical waveshapes.

9. In a musical instrument according to claim 8 wherein said means for producing musical waveshapes comprises;

a conversion means responsive to the contents of said tone generator counter wherein said selected composite data words is converted into an analog signal.

10. In a musical instrument according to claim 1 wherein said means for computing comprises;

a logic clock means for providing logic timing signals, a word counter for counting said logic timing signals modulo the number of said plurality of data words stored in said waveshape memory means, a harmonic counter incremented each time said word counter returns to its minimal count state, a computer adder-accumulator means wherein the count state of said harmonic counter is successively added to the content of an accumulator in response to said logic timing signals and wherein the content of said accumulator is initialized to a zero value at the start of a computation cycle, a sinusoid table storing a set of trigonometric function values, a sinusoid table addressing means responsive to the content of said second adder-accumulator means for reading out a trigonometric function value from said sinusoid table, a multiplying means for multiplying said read out trigonometric function value by one of said read out set of harmonic coefficients to form an output product data value, and a means for successively summing said output product data value with data words read out from said waveshape memory means and whereby the summed value is stored in said waveshape memory means.

11. In a keyboard musical instrument having a keyboard array of keyswitches, in which data words defining the waveform of a musical tone are stored in a waveshape memory and are read out sequentially and transferred to a digital-to-analog converter to be converted into musical waveshapes, apparatus for producing a plurality of musical tones each having an ensemble effect in response to an actuated keyswitch comprising;

a waveshape memory means for storing a set of data words defining the waveform of a musical tone, a keyswitch state detect means wherein a detect signal is generated in response to each actuated keyswitch in said keyboard array of keyswitches, a frequency number means for generating a plurality of frequency numbers in response to each said detect signal, a waveshape addressing means for sequentially and repetitively reading out data words stored in said waveshape memory means, a selection gate means responsive to each said plurality of frequency numbers whereby data words read out from said waveshape memory means are selected, a data combination means whereby a plurality of data words corresponding to each one of said actuated keyswitch are combined to form a combination waveshape data point, and a means for producing musical waveshapes responsive to each said combination data point whereby musical tones are produced having said ensemble effect.

12. In a musical instrument according to claim 11 wherein said frequency number means comprises;

a frequency number memory means for storing a set of frequency numbers, and a frequency number addressing means responsive to each said detect signal whereby a corresponding plurality of frequency numbers are read out from said frequency number memory means.

13. In a musical instrument according to claim 11 wherein said frequency number means comprises;

a frequency number memory means for storing a set of frequency numbers, a frequency number addressing means responsive to each said detect signal whereby a corresponding one of said set of frequency numbers is read out from said frequency number means, and an adding means for adding preselected frequency offset numbers to each said frequency number read out from said frequency number means.

14. In a musical instrument according to claim 11 wherein selection gate means comprises;

a plurality of first number registers each of which stores a frequency number generated by said frequency number means, a plurality of second number registers, each of which is associated with a corresponding one of said plurality of first number registers, and wherein each one of said plurality of second number registers stores an accumulated frequency number, a combination addressing means for accessing a frequency number from each one of said plurality of first number registers and for accessing an accumulated frequency number from each corresponding one of said plurality of second number registers, and a first adder means for adding each said accessed frequency number from said plurality of first number registers with each corresponding accumulated frequency number accessed from said plurality of second number registers to form a new value of an accumulated frequency number and whereby said new value is stored in a corresponding one of said plurality of second number registers.

15. In a musical instrument according to claim 11 wherein said waveshape addressing means comprises;

a clock for providing timing signals, a first counter for counting said timing signals modulo the number of data words stored in said waveshape memory means wherein a count reset signal is generated each time that the count state of said first counter returns to its minimal count state, and a memory accessing means responsive to the contents of said first counter for reading out data words stored in said waveshape memory means.

16. In a musical instrument according to claim 15 wherein said selection gate means further comprises;

a plurality of data latch memory means each one of which is associated with a corresponding one of said plurality of second number registers, a plurality of comparator means, each one of which is associated with a corresponding one of said plurality of second memory registers, and wherein each is responsive to the accumulated frequency number stored in said corresponding one of said plurality of second memory registers, whereby an equal signal is generated if the numerical difference between the count of said first counter and said accumulated frequency number is less than the value of a preselected comparison number, and an inhibit gate responsive to each said equal signal whereby said data words read out from said waveshape memory means are stored in said plurality of data latch memory means.

17. In a musical instrument according to claim 16 wherein said data combination means comprises;

a tone generator counter for counting each said count reset signal modulo the number of said plurality of musical tones, a number of summing means each of which is associated with a corresponding one of said actuated keyswitches wherein the data stored in selected ones of said plurality of data latch memory means are added to form a composite data word, and a composite data select means responsive to the count state of said tone generator counter whereby a corresponding composite data word is selected and provided to said means for producing musical waveshapes.

18. In a musical instrument according to claim 16 wherein each one of said number of summing means comprises;

a frequency inhibit means responsive to said accumulated frequency number stored in one of said second memory register corresponding to said one of said number of summing means whereby a selection is made of the data contained said plurality of data latch memory means that are added together to form said composite data word.

* * * * *